US005746376A

United States Patent [19]

Romann et al.

[11] Patent Number: 5,746,376

[45] Date of Patent: May 5, 1998

[54] VALVE AND METHOD FOR THE PRODUCTION OF A VALVE

[75] Inventors: Peter Romann, Stuttgart, Germany; Siegfried Rohde, Yokohama, Japan

[73] Assignee: Robert Bosch GmbH, Stuttgart, Germany

[21] Appl. No.: 575,380

[22] Filed: Dec. 20, 1995

[30] Foreign Application Priority Data

Dec. 20, 1994 [DE] Germany ..... 44 45 358.2

[51] Int. Cl.[6] ..... B05B 1/02

[52] U.S. Cl. ..... 239/585.4

[58] Field of Search ..... 239/585.1, 585.4, 239/533.12, 533.14, 590, 590.3, 596

[56] References Cited

U.S. PATENT DOCUMENTS

| | | | |
|---|---|---|---|
| 5,002,231 | 3/1991 | Reiter et al. | 239/585.1 |
| 5,174,505 | 12/1992 | Shen | 239/585.1 X |
| 5,335,864 | 8/1994 | Romann et al. | 239/585.1 |
| 5,484,108 | 1/1996 | Nally | 239/585.4 X |

FOREIGN PATENT DOCUMENTS

| | | |
|---|---|---|
| 3847742 | 6/1990 | Germany . |
| 4227785 | 1/1994 | Germany . |
| 2436887 | 9/1979 | Japan . |
| WO 89/05914 | 6/1989 | WIPO . |

*Primary Examiner*—Andres Kashnikow
*Assistant Examiner*—Robin O. Evans
*Attorney, Agent, or Firm*—Edwin E. Greigg; Ronald E. Greigg

[57] ABSTRACT

The invention is directed to a perforated spray disk which is arranged downstream of a valve seat surface, on one end of a valve seat body, and has a bulge, the collecting space formed between the valve-closing element and the bulge is first of all produced, the perforated spring disk fixed on the valve seat body, by means of a shaped body with a smaller cross section than that of the valve-closing element by plastic deformation of the perforated spray disk in its central area, the inner wall of the bulge merging directly into the wall of the valve seat surface and leads to a collecting space with a very small volume. The invention is particularly suitable for fuel injection valves of fuel injection systems for internal combustion engines.

2 Claims, 3 Drawing Sheets

VALVE AND METHOD FOR THE PRODUCTION OF A VALVE

PRIOR ART

The invention is directed to a valve and a method of producing the valve. An injection valve for fuel injection is already known (DE 38 41 142 A1). In this valve, a valve-closing element interacts with a valve seat surface formed in a valve seat body. Fixed in a recess downstream of the valve seat surface is a perforated spray disk of cup-shaped design which has a bulge in the downstream direction.

DE 42 21 185 A1 has likewise disclosed a fuel injection valve with a valve seat body, to an end face that is downstream of the valve seat surface is fixed a perforated spray disk which has a bulge pointing in the downstream direction in its central area.

In these known fuel injection valves, a collecting space is enclosed between the valve-closing element, the valve seat surface, the wall of the valve seat body and the wall of the bulge in the perforated spray disk, this space accepting a certain quantity of fuel before fuel is sprayed out via the spray openings in the perforated spray disk. This quantity of fuel and hence the collecting space should be kept as small as possible since, following the closure of the valve, the fuel is sucked out or evaporated from the collecting space in an undesirable manner owing to the vacuum in the air intake system of the internal combustion engine or heating, and this leads to an unwanted change in the quantity of fuel sprayed since, when the valve is opened again, the collecting space must first of all be filled with fuel. For reasons connected with manufacture and tolerances, the collecting spaces in the known fuel injection valves are relatively large and, in addition to the disadvantages described, these relatively large collecting spaces lead to the formation of "stagnation zones" in the fuel flow at offsets in the collecting space, these stagnation zones having an unfavourable effect on fuel metering and on the fuel jets.

ADVANTAGES OF THE INVENTION

In contrast, the valve, and the method according to the invention, have the advantage of making it possible in a simple manner to reduce the volume of the collecting space between the valve-closing element and the bulge in the perforated spray disk and to design it without abrupt changes in cross section, thereby ensuring a more favorable flow through the collecting space and better running characteristics of the internal combustion engine.

BRIEF DESCRIPTION OF THE DRAWINGS

Exemplary embodiments of the invention are illustrated in simplified form in the drawings and explained in greater detail in the description which follows.

DETAILED DESCRIPTION OF THE EXEMPLARY EMBODIMENTS

Figure 1:
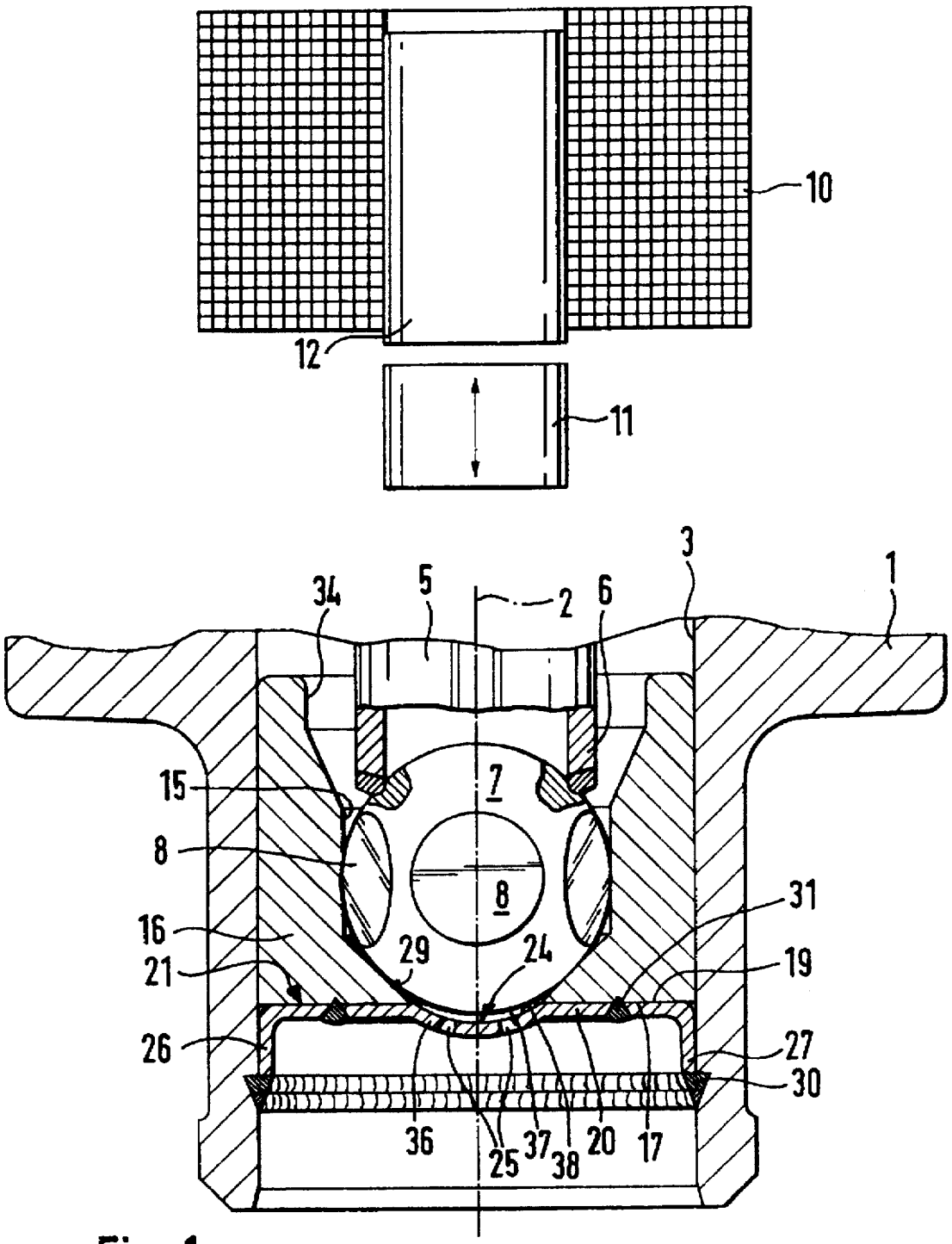
FIG. 1 shows a first exemplary embodiment of a fuel injection valve, illustrated in part, with a perforated spray disk produced in accordance with the invention.

FIG. 1 shows a partial view of an example of a valve—already known in other respects—in the form of a fuel injection valve for fuel injection systems of mixture-compressing, applied-ignition internal combustion engines, the valve being designed in accordance with the invention as the first exemplary embodiment. The injection valve has a tubular valve housing 1 in which a longitudinal opening 3 is formed concentrically with a valve longitudinal axis 2. Arranged in the longitudinal opening 3 is a valve needle 5, which is, for example, tubular and is connected at its downstream end 6 to a spherical valve-closing element 7, on the circumference of which there are, for example, five circular flats 8.

The injection valve is actuated in a known manner, for example electromagnetically. To move the valve needle 5 axially and hence open the valve counter to the spring force of a return spring (not shown) and to close the injection valve, use is made of an indicated electromagnetic circuit with a solenoid 10, an armature 11 and a core 12. The armature 11 is connected to that end of the valve needle 5 which is remote from the valve-closing element 7 by means of a laser, by a weld for example, and aligned with the core 12.

A guide opening 15 in a valve seat body 16 serves to guide the valve-closing element 7 during the axial movement. A welding process is employed to mount the cylindrical valve seat body 16 leaktightly in the downstream end of the valve housing 1, the end remote from the core 12, in the longitudinal opening 3 extending concentrically with the valve longitudinal axis 2. The periphery of the valve seat body 16 has a slightly smaller diameter than the longitudinal opening 3 in the valve housing 1. At one end 17, its lower end—that is remote from the valve-closing element 7—the valve seat body 16 is connected rigidly and concentrically to an end part 20 of a perforated spray disk 21, which is, for example, of cup-shaped design, the end part 20 thus resting by its top face 19 against the lower end 17 of the valve seat body 16. In its central area 24, the end part 20 of the perforated spray disk 21 has at least one, for example four, spray openings 25 formed by erosion or punching.

Adjoining the end part 20 of the cup-shaped perforated spray disk 21 is an all-round retaining rim 26 which extends in the axial direction on the opposite side from the valve seat body 16 and is bent outwards with a taper as far as its end 27. Since the outside diameter of the valve seat body 16 is smaller than the diameter of the longitudinal opening 3 in the valve housing 1, there is radial pressure only between the longitudinal opening 3 and the retaining rim 26, bent outwards with a slight taper, of the perforated spray disk 21.

The depth of insertion of the valve seat part comprising the valve seat body 16 and the cup-shaped perforated spray disk 21 into the longitudinal opening 3 defines the presetting of the stroke of the valve needle 5 since, with the solenoid 10 not excited, one end position of the valve needle 5 is defined by the abutment of the valve-closing element 7 against a valve seat surface 29 of the valve seat body 16. With the solenoid 10 excited, the other end position of the valve needle 5 is defined, for example, by the abutment of the armature 11 against the core 12. The distance between these two end positions of the valve needle 5 thus represent the stroke.

At its end 27, the retaining rim 26 of the perforated spray disk 21 is connected rigidly and leak-tightly to the wall of the longitudinal opening 3. For this purpose, an all-round weld 30 is provided between the end 27 of the retaining rim 26 and the wall of the longitudinal opening 3. Outside the central area 24, the end part 20 is connected leaktightly to the end 17 of the valve seat body 16 by means of another all-round weld 31. A leaktight connection between the valve seat body 16 and the perforated spray disk 21 and between the perforated spray disk 21 and the valve housing 1 is necessary to ensure that the fuel cannot flow through to the spray openings 25 between the longitudinal opening 3 in the valve housing 1 and the periphery of the valve seat body 16 or through directly into an air intake line of the internal combustion engine between the longitudinal opening 3 in the valve seat carrier 1 and the retaining rim 26 of the cup-shaped perforated spray disk 21.

The spherical valve-closing element 7 interacts with the valve seat surface 29 of the valve seat body 16, said seat surface being formed axially between the guide opening 15 and the lower end 17 of the valve seat body 16 and tapering frustoconically in the direction of flow. Facing the solenoid 10, the valve seat body 16 has a valve-seat-body opening 34 with a larger diameter than the diameter of the guide opening 15 in the valve seat body 16.

To ensure exact guidance of the valve-closing element 7 and hence of the valve needle 5 during the axial movement, the diameter of the guide opening 15 is such that, outside its flat areas 8, the spherical valve-closing element 7 extends through the guide opening 15 with a small radial clearance.

The central area 24 of the end part 20 of the perforated spray disk 21 is bent out of the plane of the end part 20 in the downstream direction, i.e. away from the valve-closing element 7, giving a bulge 36 in the central area. A collecting space 37 is formed between the valve-closing element 7, the valve seat surface 29 and the wall of the bulge 36, and it is into this space that the fuel passes first when the valve-closing element 7 is raised from the valve seat surface 29, before being metered through the spray openings 25 and sprayed into the air intake line of the internal combustion engine. In the first exemplary embodiment, shown in FIG. 1, the bulge 36 is in the form of a spherical shell, the inner wall 38 of the bulge 36 merging directly, i.e. without an offset, into the valve seat surface 29. The volume of the collecting space 37 is here kept as small as possible by appropriate choice of the course of the valve seat surface 29 and of the inner wall 38 of the bulge 36 in relation to the surface of the spherical valve-closing element 7.

Figure 2:
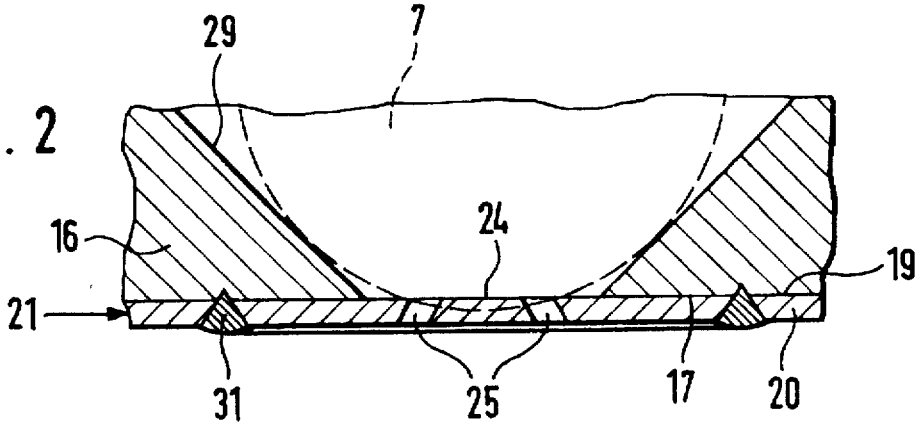
FIGS. 2 to 4 show individual production steps for the exemplary embodiment shown in FIG. 1, and FIGS. 5 to 7 show individual production steps in accordance with a second exemplary embodiment.
Figure 3:
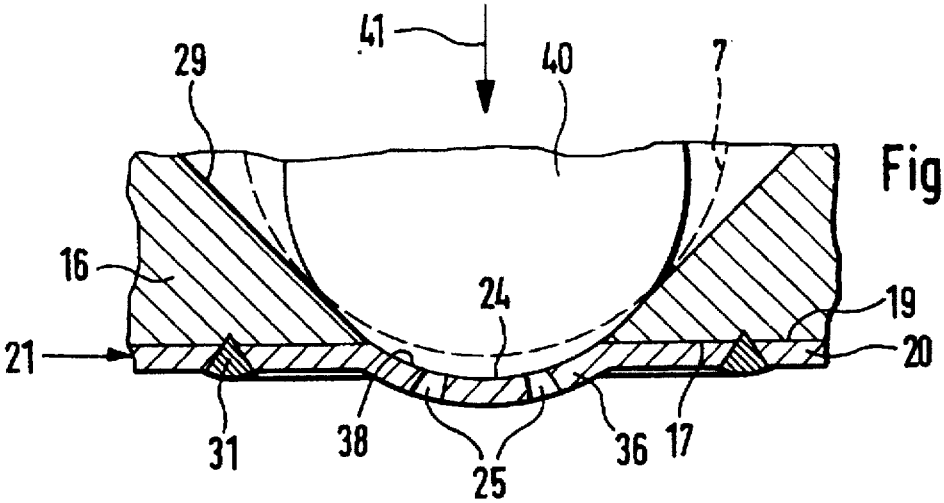
Figure 4:
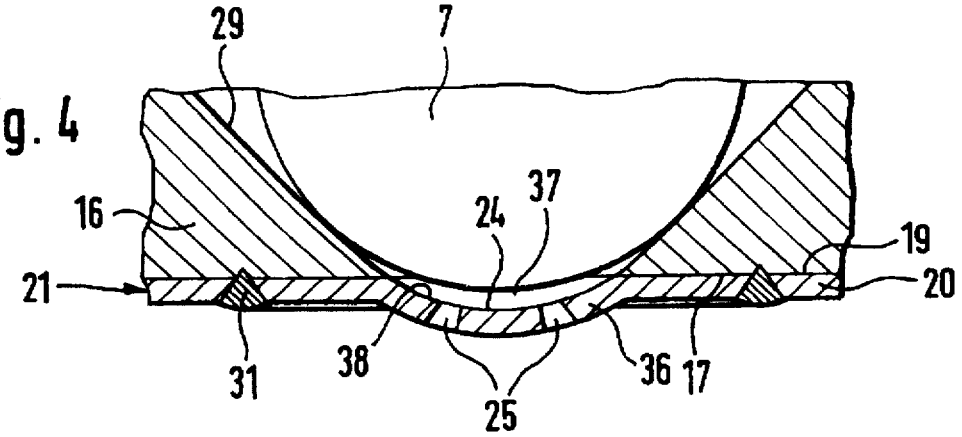

FIGS. 2 to 4 show, in partial views, steps of the method for achieving the bulge 36 and the collecting space 37 in accordance with the first exemplary embodiment, shown in FIG. 1. For parts which are the same or have the same action, the same reference numerals are used as those used in FIG. 1. Before the valve seat body 16 is installed in the valve housing 1, the perforated spray disk 21, which is completely flat, at least in its end part 20, is first of all placed by its top face 19 against the end 17 of the valve seat body 16. The valve seat surface 29, which tapers conically in the direction of flow in the form of the lateral surface of a cone, ends directly at the top face 19 of the perforated spray disk 21, surrounding the central area 24 of the perforated spray disk, from which the spray openings 25 emanate. Outside the central area 24, the perforated spray disk 21 is connected leaktightly to the end 17 of the valve seat body 16 by means of the all-round weld 31. If a valve-closing element 7, designed for example as a ball, such as that illustrated in broken lines in FIG. 2, were introduced into the valve seat body 16, it would strike against the top face 19 of the perforated spray disk 21 and would not come into contact with the valve seat surface 29 since the diameter of the spherical valve-closing element 7 and the slope of the valve seat surface 29 are configured in such a way that the valve-closing element 7 projects beyond the end 17 of the valve seat body 16 when it is resting on the valve seat surface 29. In a further step of the method, shown in FIG. 3, a shaped body 40 is introduced into the valve seat body 16 instead of the valve-closing element 7 and is brought to rest on the top face 19 of the perforated spray disk 21. The shaped body 40 has the same profile as the valve-closing element 7 for example, i.e., in the exemplary embodiment, the profile of a ball, but has a smaller cross section than the valve-closing element 7. The shaped body is then moved towards the perforated spray disk 21, by means of a force 41 acting on the shaped body 40 in the direction of the perforated spray disk 21, until the bulge 36 with the profile of the shaped body 40 is formed on the perforated spray disk 21 in its central area 24 by plastic deformation and the inner wall 38 of the bulge 36 merges directly into the wall of the valve seat surface 29. The radius of the spherical shaped body 40 can here be chosen in such a way, for example, that, after the production of the bulge 36, the valve seat surface 29—representing the lateral surface of a cone—merges tangentially into the adjoining inner wall 38 of the bulge 36. In order to facilitate the plastic deformation of the central area 24 by the shaped body 40, the perforated spray disk 21 can be heated in the central area 24 during the deformation. On completion of the deformation, the shaped body 40 is removed from the valve seat body 16 again. During the formation of the bulge 36, the spray openings 25 (see FIG. 2), which initially have parallel walls, are deformed in such a way that they take on a conically widening configuration in the direction of flow. However, spray openings which widen in the direction of flow in such a way bring with them the advantage that they lead to stable throughflow and good fuel preparation. The course of the valve seat surface 29 and the cross section of the shaped body 40 can also be chosen so that it is not only the perforated spray disk 21 which is deformed plastically in its central area 24 during the production of the bulge 36 but also an edge region of the valve seat body 16 in the vicinity of the end 17, thereby likewise generating a direct, offset-free transition between the valve seat surface and the inner wall 38 of the bulge. Finally, after the removal of the shaped body 40, the valve seat body is introduced into the longitudinal opening 3 in the valve housing 1 and fixed therein in the manner described above by means of the weld 30. FIG. 4 shows a valve seat body 16 with a perforated spray disk 21 fixed on it which has a bulge 36 produced in accordance with the invention into which the valve-closing element 7, which rests on the valve seat surface 29, extends, projecting beyond the end 17. A collecting space 37 with as small a volume as possible is thereby achieved.

Figure 5:
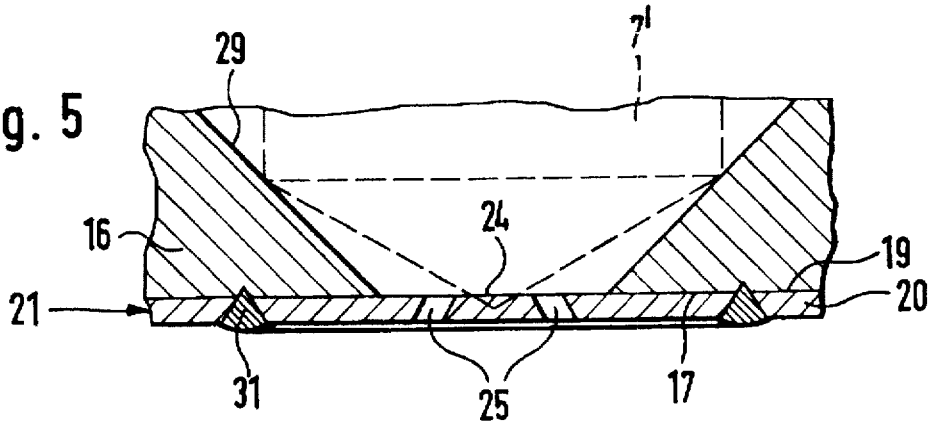
Figure 6:
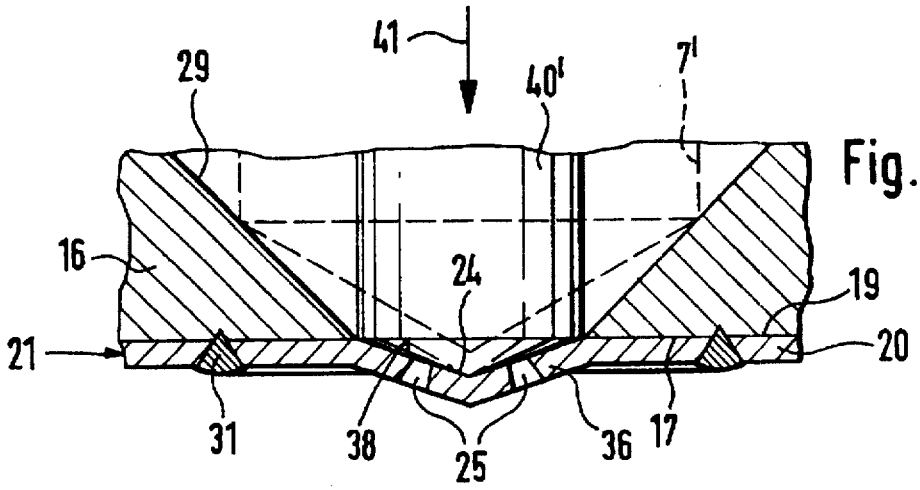
Figure 7:
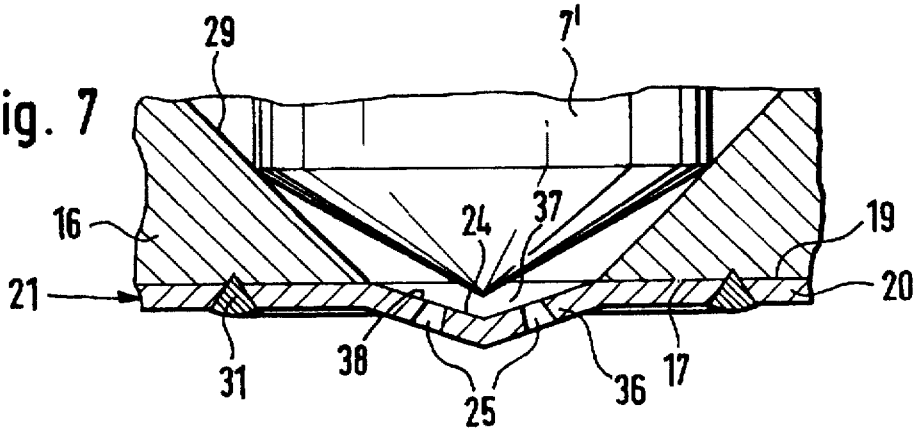

In the second exemplary embodiment of the method according to the invention for the production of a perforated spray disk 21 with a bulge 36, this second embodiment being illustrated in FIGS. 5 to 7, those parts which remain the same or have the same action as those in the previous figures are denoted by the same reference numerals. In the second exemplary embodiment, the valve-closing element 7' does not have a spherical shape but a conical shape, which is illustrated in broken lines in FIG. 5. FIG. 5 first of all shows how the flat perforated spray disk 21 is fixed on the end 17 of the valve seat body 16 by means of the weld 31. In FIG. 6, a conical shaped body 40' is introduced into the valve seat body 16 instead of the valve-closing element 7' and placed on the top face 19 of the perforated spray disk 21. The shaped body 40' has approximately the cross section of the central area 24 or is slightly larger. With the action of the force 41 on the shaped body, the conical profile of the shaped body 40' is moved downwards and, in the process, plastically deforms the perforated spray disk 21 in its central area 24, giving a conical bulge 36, the inner wall 38 of which merges directly into the valve seat surface 29. The shaped body 40' is then removed from the valve seat body 16 and the valve seat body 16 is fixed on the valve housing 1 in the manner described above. FIG. 7 shows the conical valve-closing element 7' in contact with the valve seat surface 29, the point projecting beyond the end 17 of the valve seat body 16 into the conical bulge 36, thereby giving as small as possible a volume of the collecting space 37.

The foregoing relates to preferred exemplary embodiments of the invention, it being understood that other variants and embodiments thereof are possible within the spirit and scope of the invention, the latter being defined by the appended claims.

We claim:

1. A fuel injection valve for a fuel injection system of internal combustion engines, which comprises a valve housing, a valve seat body having a downstream end and is arranged within said housing, a movable valve-closing spherical shaped element which interacts with a valve seat surface formed in said valve seat body, a wall of said valve seat surface extends to said downstream end of the valve seat body, a perforated spray disk which is arranged downstream of the valve seat surface on said downstream end of the valve seat body, said perforated spray disk has a bulge in a central area having a shape of a spherical shell with said bulge in a direction away from the valve seat body into which the valve-closing element projects and in which at least one spray opening is provided, wherein the perforated spray disk (21) is rigidly connected to said downstream end (17) of the valve seat body (16) in an area outside the bulge (36), and a wall (38) of the bulge (36) merges directly into said wall of the valve seat surface (29) whereby a small volume collecting space is formed.

2. A fuel injection valve for a fuel injection system of internal combustion engines, which comprises a valve housing, a valve seat body having a downstream end and arranged, within said housing, a movable valve-closing element which is conical shaped and interacts with a valve seat surface formed in said valve seat body, a wall of said valve seat surface extends to said downstream end of the valve seat body, a perforated spray disk which is arranged downstream of the valve seat surface on said downstream end of the valve seat body, said perforated spray disk has a bulge in a central area having a conical shape with said bulge in a direction away from the valve seat body into which the conical shaped valve-closing element projects and in which at least one spray opening is provided, wherein the perforated spray disk (21) is rigidly connected to said downstream end (17) of the valve seat body (16) in an area outside the bulge (36), and a wall (38) of the bulge (36) merges directly into said wall of the valve seat surface (29) whereby a small volume collecting space is formed.

* * * * *